US006276547B1

(12) United States Patent
Petryna

(10) Patent No.: US 6,276,547 B1
(45) Date of Patent: Aug. 21, 2001

(54) FOOD CONTAINERS WITH DETACHABLE AND DISCARDABLE SECTIONS

(76) Inventor: Thomas M. Petryna, 615 Guy St., Cornwall (CA), K6H 4V9

( * ) Notice: Subject to any disclaimer, the term of this patent is extended or adjusted under 35 U.S.C. 154(b) by 0 days.

(21) Appl. No.: 09/590,463

(22) Filed: Jun. 9, 2000

(51) Int. Cl.[7] ..... B65D 6/28
(52) U.S. Cl. ..... 220/4.03; 220/4.26
(58) Field of Search ..... 220/4.03, 4.26, 220/4.27, 4.33

(56) References Cited

U.S. PATENT DOCUMENTS

| | | | | |
|---|---|---|---|---|
| 2,782,913 | * | 2/1957 | Devick | 220/4.03 |
| 4,778,068 | * | 10/1988 | Kohus | 220/4.03 |
| 4,852,757 | * | 8/1989 | Gold | 220/4.03 |
| 5,060,799 | * | 10/1991 | De Pagter | 220/4.03 |
| 5,215,222 | | 6/1993 | McGill . | |
| 5,626,250 | | 5/1997 | Dorazio . | |
| 6,003,706 | | 12/1999 | Rosen . | |

FOREIGN PATENT DOCUMENTS

| | | |
|---|---|---|
| 2160344 | 10/1994 | (CA) . |

* cited by examiner

*Primary Examiner*—Joseph M. Moy
(74) *Attorney, Agent, or Firm*—Dority & Manning, PA

(57) ABSTRACT

An incrementally variable volume container includes a sectionalised side wall and a closed bottom end. Each section has a top rim with an external thread for engaging a threaded lid. A tear strip is integrally molded between each top rim and a next section of the container to permit the next section to be removed. The container is used to contain perishable liquid, semi-solid or granular food items. The sections can be detached and discarded as the food content is consumed, and the lid can be used to close any section in fluid tight seal. Air volume in the container above the food content is thereby reduced and the freshness of the food content is maintained.

15 Claims, 2 Drawing Sheets

FOOD CONTAINERS WITH DETACHABLE AND DISCARDABLE SECTIONS

FIELD OF THE INVENTION

The present invention relates to containers, and in particular, to a container having sectionalised side walls to facilitate reduction of a volume of the container as contents of the container are used.

BACKGROUND OF THE INVENTION

It is well known that the freshness of food products is adversely affected by oxidation, which results from exposure to air. Oxidation is a particular problem with processed food products that are consumed slowly, such as peanut butter, sauces, jellies and preserves, for example. Such products are normally sold in jars that are not adapted to compensate for the exposure of the product to a volume of air trapped in a top of the container as product is removed from the container. It is therefore desirable to reduce air space as food product is removed from a container.

Containers having variable internal volume are known in the art. A deformable corrugated dispensing container, exemplary of variable volume dispensing containers, is described in U.S. Pat. No. 5,215,222 which issued to McGill on Jun. 1, 1993. The dispensing container is designed to collapse as product is expelled under pressure.

Collapsible containers are also known that are adapted to permit air space above food contents to be reduced. An example is described in Canadian Patent Application No. 2,160,344 to Robbins, entitled IMPROVED REUSABLE AND RE-COLLAPSIBLE CONTAINER AND ASSOCIATED CAP, which was filed on Apr. 14, 1994 and laid open to public inspection on Oct. 27, 1994. This application describes a collapsible container with a cap. The container has a side wall designed to be collapsed by forcing the side wall downwardly as contents of the container are consumed in order to reduce the air space above the contents. The container is made of a resilient thermoplastic which permits the container to be repeatedly collapsed and uncollapsed .

Disposable containers are known for food products. A variable volume and disposable container is described in U.S. Pat. No. 5,626,250, entitled CONTAINER APPARATUS HAVING DETACHABLE AND DISCARDABLE WALL SECTIONS, and issued on May 6, 1997 to Dorazio. The container structure includes a cylindrical side wall having a closed bottom and a plurality of side wall sections connected by tear strips to the container. The container is designed for semi-solid food products such as ice cream. As ice cream is consumed from the container the tear strips are removed. Removal of a tear strip causes perforations of the side wall to permit a section above the tear strip to be removed. The head space above the ice cream is hereby reduced. The container is made from paper board and is therefore unsuitable for liquids. Moreover, the lid does not provide a fluid tight seal, which is necessary for most food products sold in jars.

The known solutions for providing a variable volume container for perishable food products have not been widely accepted by consumers. There therefore still exists a need for a sturdy, fluid tight container that is both reclosable and readily reduced in volume.

SUMMARY OF THE INVENTION

An object of the present invention is to provide a variable volume container that permits air space above the contents of the container to be reduced after a certain volume of the contents have been used.

It is another object of the invention to provide a variable volume container having a sectionalised side wall and associated lid that provides a fluid tight container regardless of the number of sections removed from the side wall.

In general terms, the invention provides a variable volume container comprising a continuous, sectionalised side wall, having a closed bottom end. Each section of the side wall has a top rim that includes means for securing a lid adapted to engage the top rim in a fluid tight seal. A tear strip is provided between adjacent side wall sections for separating the sections of the side wall from the top rim. An associated lid for the container has an engagement member for securing the lid to the respective top rims so that the container can be closed in a fluid tight seal, regardless of the number of the sections removed from the side wall.

The means for securing the lid to the top rim is preferably an external thread and the engagement member on the lid is preferably an internal thread in a depending skirt of the lid. The container is preferably molded from a thermoplastic material and the tear strip is integrally molded between the top rim and an adjacent section of the container.

In a preferred embodiment, the container comprises a cylindrical and sectionalised side wall having a closed bottom end and at least a bottom section and top section. Each section of the side wall has a top rim that includes an external thread for securing a lid that is adapted to engage the top rim of the sections in a fluid tight seal. A tear strip is integrally molded between the top rim of the bottom section and the top section for separating the top section from the side wall. A lid for the container is also provided. The lid has an internal thread for engaging the external thread of the top rim of the top section or the bottom section when the top section is removed from the side wall. The lid permits the container to be closed in a fluid tight seal, regardless of the number of sections remaining in the body of the container.

The present invention provides a variable volume container which is advantageously used for liquid or semi-solid foods because the container is fluid tight. The molded single piece structure enables the container to be manufactured at low cost, which is important for disposable containers.

DETAILED DESCRIPTION OF THE PREFERRED EMBODIMENT

Figure 1:
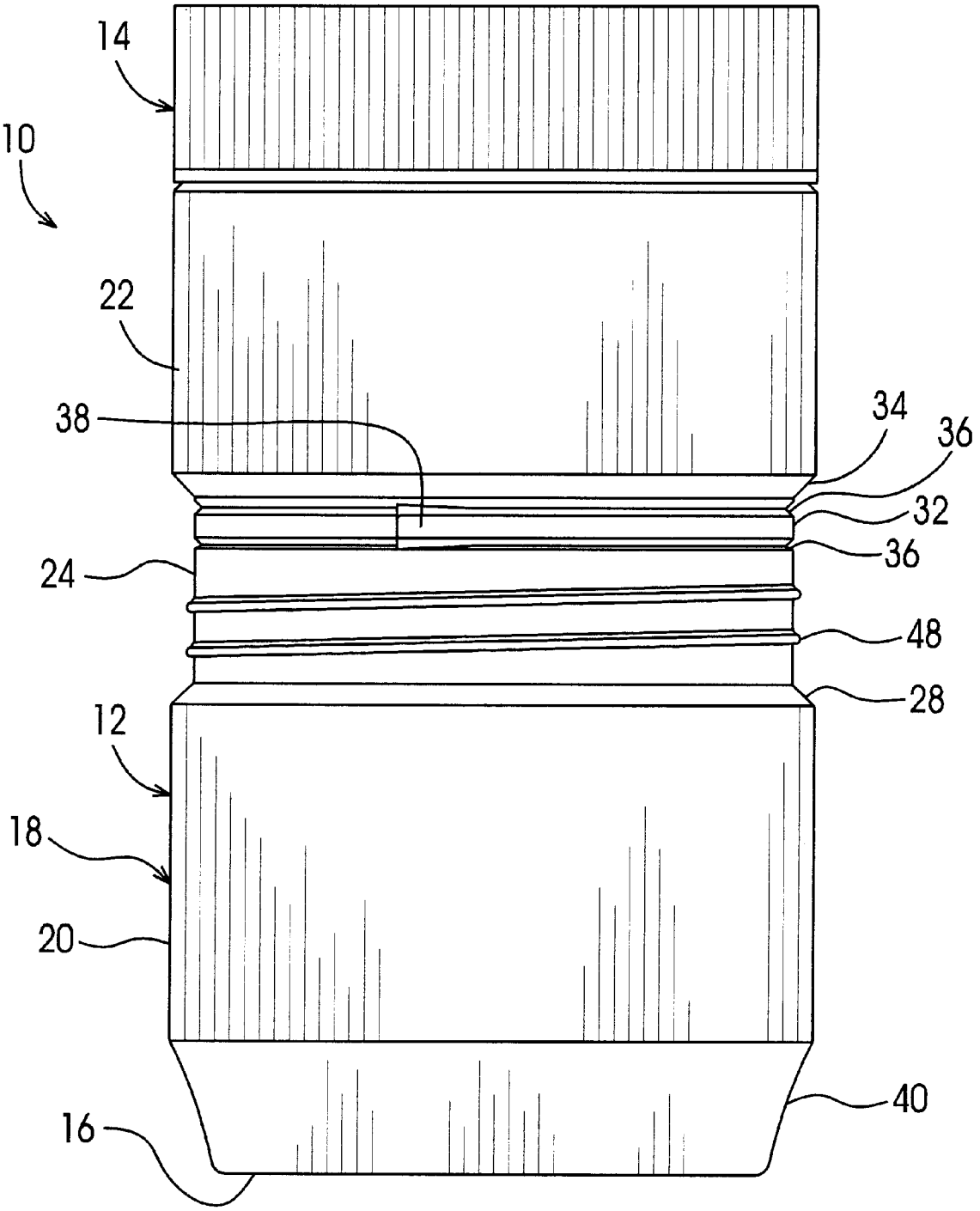
FIG. 1 is an elevational side view of a container in accordance with a preferred embodiment of the invention.

FIG. 1 illustrates a cylindrical container in accordance with the invention, generally indicated by reference 10. The container 10 includes a cylindrical body 12 and a lid 14. The cylindrical body 12 has a closed bottom end 16 and a cylindrical side wall 18 which is an integral but sectionalised structure. The sectionalised side wall 18 includes at least a bottom section 20 and a top section 22. However, it should be understood that the sectionalised side wall 18 could include more than two sections, if desired. Each of the sections 20, 22 has a top rim 24, 26 (see FIG. 2). The top rims 24, 26 may have a smaller diameter than the diameter of the cylindrical side wall 18. A shoulder 28 provides a transition between the top rim 24, and the side wall 18 of the bottom section 20. A second shoulder 30 provides a similar transition between the top rim 26 and the side wall 18 of the top section 22. A tear strip 32 is integral with the top rim 24 of the bottom section 20 and a transition surface 34 between the top section 22 and the tear strip 32. Two grooves 36 flank the tear strip 36 to facilitate the removal thereof. A pull tab 38 is provided to enable the tear strip 32 to be easily gripped for removal.

In the embodiment illustrated, the closed bottom end has a diameter smaller than the diameter of the cylindrical side wall 18. The side wall 18 is tapered at the bottom end, as indicated at 40.

The container body 12 is preferably molded from a thermoplastic material. Injection molds or blow molds may be used but blow molds are preferred.

Figure 2:
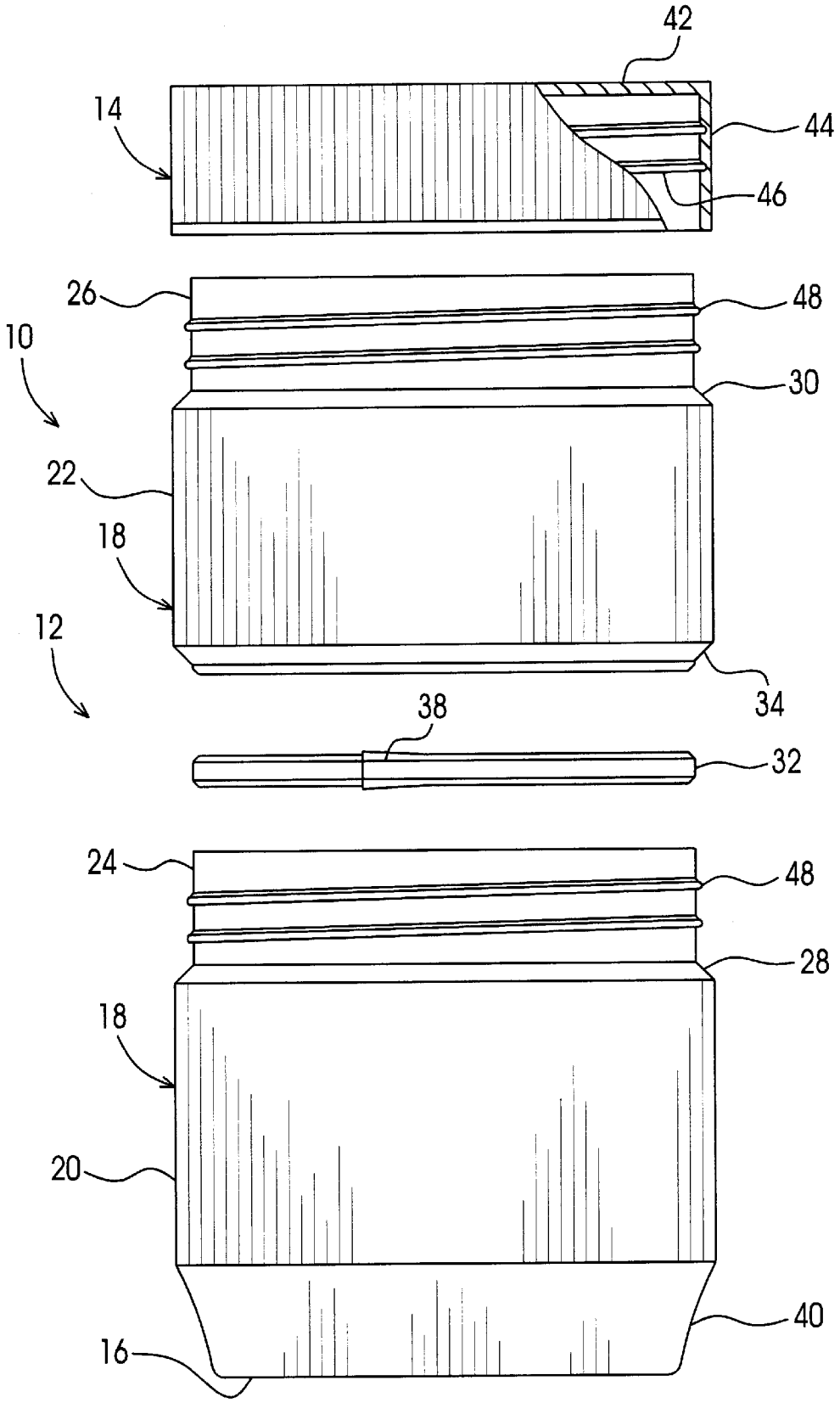
FIG. 2 is an exploded side view of the container shown in FIG. 1, illustrating a top section removed from a bottom section of the container.

As shown in FIG. 2 the lid 14 includes a circular top plate 14 and a skirt 44 that depends from a periphery of the top plate 42. The skirt 44 has an internal diameter that is slightly larger than the diameter of the top rim 24, 26, and an external diameter substantially equal to the diameter of the cylindrical side wall 18.

An internal thread 46 is provided on the inner surface of the skirt 44. A corresponding external thread 46 is provided on both the top rim 24 and 26, so that the lid 14 may be closed in a fluid tight seal resulting from the abutment of the top plate 42 of the lid 14 against the edge of the top rim 24 or 26. As is well understood in the art, seals of various kinds can be provided between the top plate 42 of the lid 14 and the edge of the top rim 24 or 26.

In use of the container, the container 10 is filled with perishable food content so that the air space above the content is fairly small. This is good for maintaining the freshness of the food during storage. After the container 10 is opened and a part of the content is consumed, the air space above the content increases, which exposes the contents to a greater volume of air. The greater the volume of air trapped inside the container, the more the freshness of the contents is likely to be affected. Consequently, when the contents of the container are consumed to an extent that the top section 22 is emptied, the top section 22 is detached and discarded by gripping the pull tab 38 and pulling off the tear strip 32. The lid 14 is used to close the bottom section 20, and the trapped volume of air over the remaining food contents is dramatically reduced.

It is to be understood that the invention is not limited to the illustrations described and shown above, which are deemed to be merely illustrative to the best modes of carrying out the invention. In particular, a container having sectionalised side walls may include three or more sections in accordance with the present invention to provide more variability in the volume of the container.

Modifications and improvements to the above described embodiment of the invention may become apparent to those skilled in the art. The foregoing description is intended to be exemplary rather than limiting. The scope of the invention is therefore intended to be limited solely by the scope of the appended claims.

What is claimed is:

1. A variable volume container comprising:

a continuous, sectionalized side wall having a closed bottom end, each section of the side wall having a top rim that includes an external thread for securing a lid that is adapted to engage the top rim in a fluid tight seal;

an integral tear strip disposed between adjacent sections of the side wall for separating the sections of the side wall from the respective top rims; and, a lid having a dependant skirt defining an internal thread for securing the lid to the top rims, so that the container can be closed in a fluid tight seal regardless of the number of sections removed from the side wall.

2. A container as claimed in claim 1 wherein the container is molded from a thermoplastic material.

3. A container as claimed in claim 1 wherein the tear strip is integrally molded with the top rim and a next section of the container.

4. A container as claimed in claim 1 wherein the lid is made of molded thermoplastic material.

5. A container as claimed in claim 1 wherein the container is cylindrical.

6. A container as claimed in claim 1 wherein the tear strip includes a pull tab to facilitate the removal.

7. A container having an incrementally variable volume, comprising:

a thermoplastic, cylindrical, sectionalized side wall having a closed bottom end and at least a bottom section and a top section, each section of the side wall having a top rim that includes an external thread for securing a lid that is adapted to engage the top rim of a selected one of the sections in a fluid tight seal;

a tear strip integrally molded between the top rim of the bottom section and a bottom of the top section for separating the top section from the top rim of the bottom section; and, the lid having an internal thread for engaging the external thread of the top rim of the top section or the external thread of the top rim of the bottom section when the top section is removed from the side wall, so that the container can be closed in a fluid tight seal regardless of the number of sections remaining in the body of the container.

8. A container as claimed in claim 3 wherein the tear strip includes a pull tab to facilitate the removal.

9. A sectionalized container comprising:

a side wall having a plurality of sections, each one of said plurality of sections defining a top rim adapted for threaded engagement by a lid, said side wall further defining a closed bottom end;

at least one tear strip operatively disposed on said side wall between adjacent portions of said plurality of sections; and, a threaded lid adapted for the mated engagement of said top rims.

10. A container according to claim 9 wherein the top rim defines an external thread, and the lid further defines an internal thread in a depending skirt of the lid.

11. A container as claimed in claim 9 wherein the container is molded from a thermoplastic material.

12. A container as claimed in claim 9 wherein the tear strip is integrally molded with the top rim and a next section of the container.

13. A container as claimed in claim 9 wherein the lid is made of molded thermoplastic material.

14. A container as claimed in claim 9 wherein the container is cylindrical.

15. A container as claimed in claim 9 wherein the tear strip includes a pull tab to facilitate removal of the tear strip.

* * * * *